US005660581A

United States Patent [19]

Shin et al.

[11] Patent Number: 5,660,581

[45] Date of Patent: Aug. 26, 1997

[54] GRINDING APPARATUS

[75] Inventors: Shoichi Shin, Tagata-gun; Masafumi Tsunada; Yasuhiko Nagakura, both of Numazu, all of Japan

[73] Assignee: Toshiba Kikai Kabushiki Kaisha, Tokyo-to, Japan

[21] Appl. No.: 620,335

[22] Filed: Mar. 22, 1996

[30] Foreign Application Priority Data

Mar. 24, 1995 [JP] Japan ..... 7-065735

[51] Int. Cl.[6] ..... B24B 7/22

[52] U.S. Cl. ..... 451/289; 451/285; 414/225

[58] Field of Search ..... 451/41, 285, 287, 451/288, 289; 414/224, 225; 901/6, 7

[56] References Cited

U.S. PATENT DOCUMENTS

| | | | |
|---|---|---|---|
| 4,797,052 | 1/1989 | Ohta et al. | 414/225 |
| 5,177,514 | 1/1993 | Ushijima et al. | 414/225 |
| 5,329,732 | 7/1994 | Karlsrud et al. | 451/289 |
| 5,405,230 | 4/1995 | Ono et al. | 414/225 |
| 5,451,130 | 9/1995 | Kempf | 414/225 |
| 5,498,116 | 3/1996 | Woopruff et al. | 414/225 |

*Primary Examiner*—Eileen P. Morgan
*Attorney, Agent, or Firm*—Cushman Darby & Cushman IP Group of Pillsbury Madison & Sutro, LLP

[57] ABSTRACT

There is provided a grinding apparatus which assures that a polishing cloth is automatically exchanged with a new one for a short time while suppressing the generation of abrasive grain and cut chips.

The grinding apparatus includes a lower turn table rotatably supported about a vertical shaft, an upper turn table detachably disposed on the lower disc and having an abrasive cloth adhesively attached to the surface thereof, a first turn table holder for holding an unused upper turn table having a new abrasive cloth preliminary adhesively attached thereto, a second turn table holder for holding used upper turn table disconnected from the lower turn table, a turn table exchanging device including chucking means capable of seizing the turn table, serving to convey the turn table to the second turn table holder, and moreover, to take the an upper turn table from first turn table holder and place it on the lower turn table, and position determining and stopping means for stopping the turn table at the rotational angular position where the chucking means of the turn table exchanging device is engageable.

6 Claims, 2 Drawing Sheets

GRINDING APPARATUS

BACKGROUND OF THE INVENTION

The present invention relates generally to a grinding apparatus. More particularly, the present invention relates to an exchanging apparatus for exchanging a turn table having a polishing cloth adhesively attached to the surface thereof for smoothly finishing the surface of a wafer usable for a semiconductor device with a new one.

A chemical mechanical polishing process is utilized for polishing a single crystal silicon. This chemical mechanical polishing process is an operation for smoothly finishing the surface of a silicon wafer while feeding a polishing liquid to the working part by thrusting the silicon wafer to be processed against a rotating turn table having a polishing cloth adhesively attached thereto.

Since high flatness accuracy is required for practicing the step of polishing the silicon wafer, it is necessary that the worn polishing cloth is often exchanged with a new one.

To exchange the polishing cloth on the turn table with a new one, operations for peeling the worn polishing cloth from the turn table after stopping the grinding apparatus, and then adhesively attaching a new polishing cloth to the turn table are required. A series of operations as mentioned above are hitherto mostly achieved with an operator's hand.

Since abrasive grains are undesirably attached to the surface of the turn table after the used worn polishing cloth is peeled from the turn table, there are many operations to be performed in association with adhesive attaching of a new polishing cloth, e.g., cleaning the surface of the turn table with pure water or the like.

Since chemical mechanical polishing work is achieved for semiconductor wafer while a polishing cloth is often manually exchanged with a new one in the above-described manner, many manhours are required for the exchanging operation. In addition, there arises a problem that abrasive grains are scattered away when the used worn polishing cloth is peeled from the working turn table, causing them to be undesirably attached to a semiconductor producing apparatus.

SUMMARY OF THE INVENTION

The present invention has been made in consideration of the aforementioned background.

Hence, an object of the present invention is to provide a grinding apparatus which assures that a polishing cloth is automatically exchanged with a new one for a short period of time while preventing abrasive grains from being scattered away therefrom without any appearance of the problems inherent to the prior art.

To accomplish the above object, the present invention provides a grinding apparatus for polishing a work by thrusting it against the surface of a rotating polishing cloth, wherein the polishing apparatus includes a lower turn table rotatably supported to rotate about a vertical shaft, an upper turn table concentrically and detachably arranged on the lower turn table, a polishing cloth being adhesively attached to the surface of the upper turn table, a first turn table holder for holding an unused upper turn table having a new polishing cloth preliminarily adhesively attached thereto, a second turn table holder for holding a used upper turn table thereon, the used upper turn table being disconnected from the lower turn table, a turn table exchanging device including chucking means capable of seizing the upper turn table and serving to convey a used upper turn table to the second turn table, and take an unused upper turn table from the first turn table holder to place it on the lower turn table, and position determining and stopping means for stopping the upper turn table at the rotational angular position where the chucking means of the turn table exchanging device can be engaged with cutout grooves of the upper turn table.

In addition, the grinding apparatus includes a hot air blowing device for blowing hot air toward the outer peripheral part of a polishing cloth of the upper turn table, a pure water cleaning device for feeding pure water to the upper turn table fitting surface of the lower turn table, and a raising and lowering trough surrounding the lower turn table.

Additionally, it is preferable that the grinding apparatus includes pressurizing means for feeding compressed air to a superimposing surface between the upper turn table and the lower turn table and vacuum sucking means for applying negative pressure to the superimposing surface.

The pressurizing means and the vacuum sucking means include a passage extending through the lower turn table and central part of a rotational shaft so that a pressure circuit and a vacuum circuit are selectively changeably connected to the passage.

A conveying robot arranged between the grinding apparatus and the turn table holder including chucking means adapted to be detachably engaged to cutout grooves of the upper turn table can be used for the grinding apparatus.

When the turn table is stopped at the stopping position for the purpose of exchanging, the turn table exchanging device enters so that the chuck is engaged with the cutout grooves of the upper turn table. The turn table exchanging device disconnects the upper turn table from the lower turn table and then conveys the upper turn table onto the second turn table holder. After the upper turn table is placed on the second turn table holder, the turn table exchanging device seizes an unused upper turn table from the first turn table holder and then places the upper turn table on the lower turn table as it is. Thus, the polishing cloth is automatically exchanged with a new one together with the upper turn table.

When the upper turn table is exchanged, the hot air blowing device blows hot air toward the upper turn table before the upper turn table is disconnected from the lower turn table, and drys the upper turn table in such a manner that water droplets do not drop from the upper turn table. After the upper turn table is disconnected from the lower turn table, the surface of the lower turn table is washed with pure water fed from the pure water feeding device. When the lower turn table is dried, a trough is raised up to prevent abrasive grains or the like from being scattered away, whenthe lower turn table is washed, the used pure water is recovered in the trough.

The pressurizing means feeds compressing air to the superimposing surface so as to allow the upper turn table to be readily disconnected from the upper turn table. The vacuum sucking means is actuated after a new upper turn table is placed on the lower turn table so that the upper turn table comes in close contact with the lower turn table.

According to the present invention, when the abrasive cloth adhesively attached to the rotating upper turn table is worn, a new unused polishing cloth can automatically be exchanged with the worn polishing cloth.

Further, according to the present invention, since the grinding apparatus is additionally equipped with a hot air blowing device and a pure water cleaning device, when the upper turn table is exchanged, adhesion of abrasive grains or cut chips generated at that time to the upper turn table can reliably be prevented, a secondary operation such as a cleaning operation or the like can automatically be performed, and moreover, a time consumed for achieving the exchanging operation can be shortened.

DESCRIPTION OF THE PREFERRED EMBODIMENT

The present invention will now be described in detail hereinafter with reference to the accompanying drawings which illustrate a preferred embodiment thereof.

Figure 1:
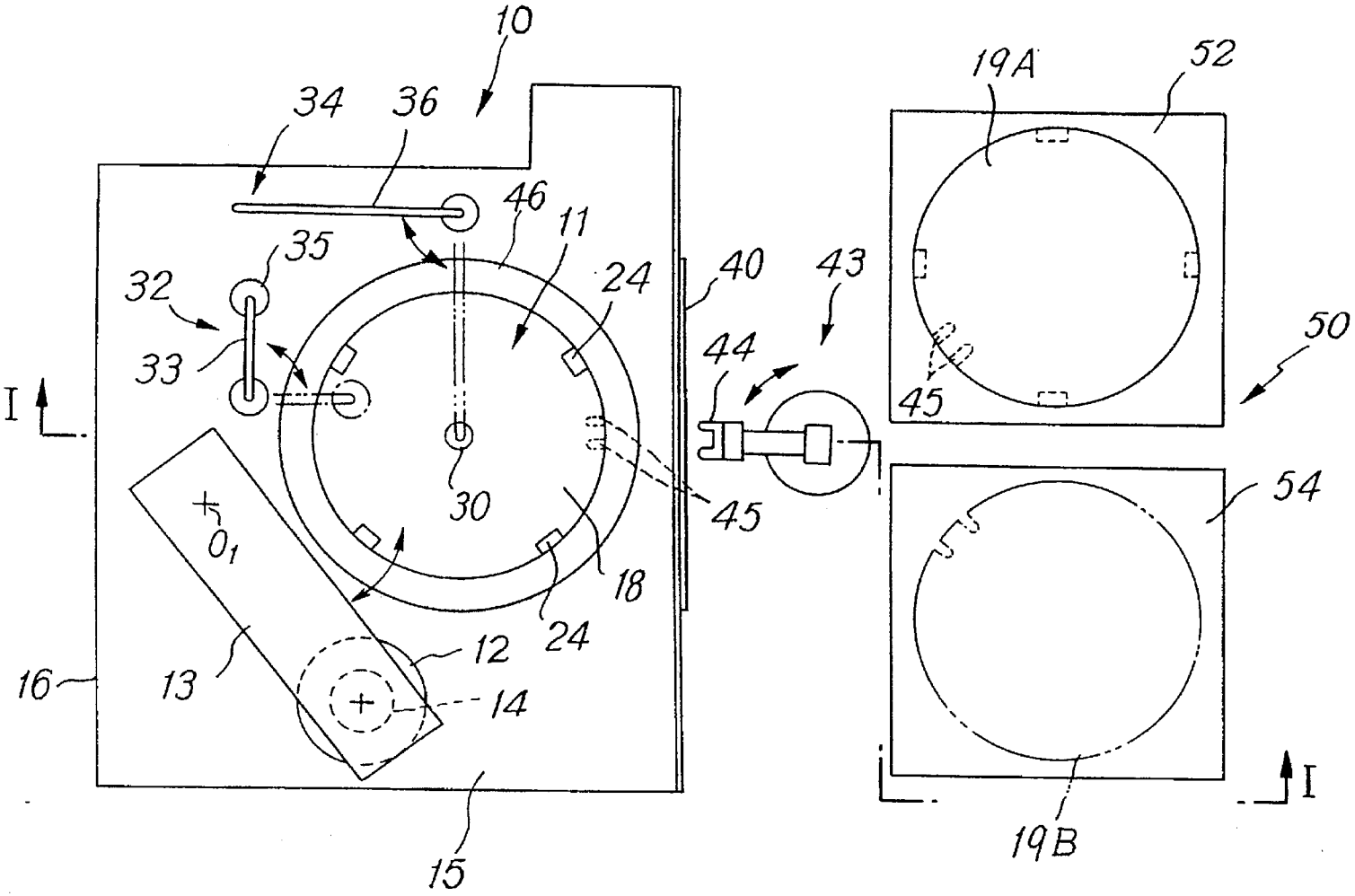
FIG. 1 is a plan view of a grinding apparatus which is constructed in accordance with an embodiment of the present invention.
Figure 2:
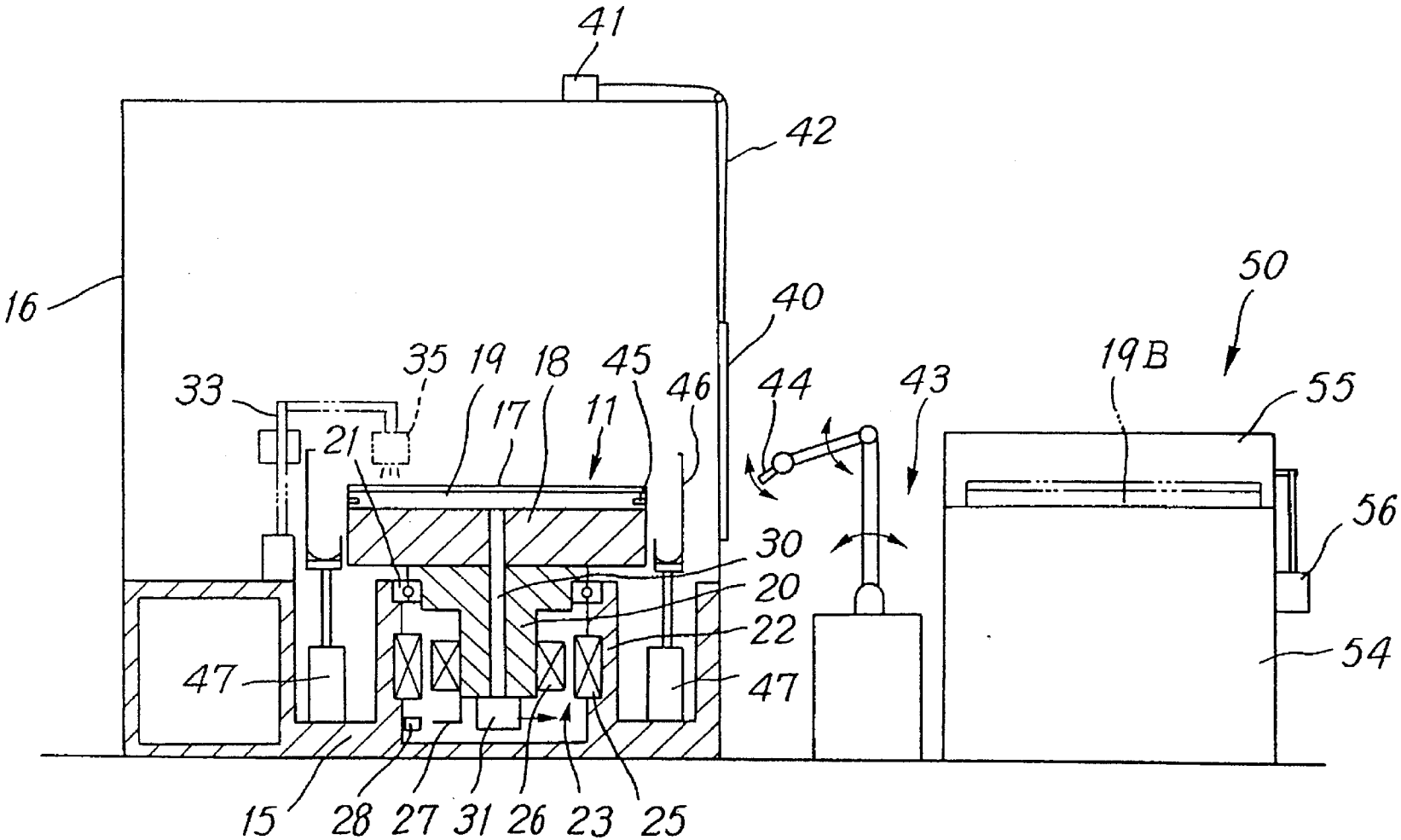
FIG. 2 is a sectional side view of the grinding apparatus taken in line I—I in FIG. 1.

In FIG. 1 and FIG. 2, reference numeral 10 designates a whole grinding apparatus. The grinding apparatus 10 includes a turn table 11 rotatable in a horizontal surface and a loader device 12 for bringing and discharging a semiconductor wafer to be worked to and from the upper surface of the turn table 11. The loader device 12 includes an arm 13 which is turnable about a turn center $O_1$, and a wafer suction head 14 is attached to the foremost end of the arm 13. The turn table 11 and the arm 13 are mounted on a platform 15, and the platform 15 is fully covered with a box-like cover 16 so as to allow the whole platform 15 to be covered in order to prevent abrasive grains, dust or the similar foreign material to be scattered away therefrom. The suction head 14 sucks the wafer, and thereafter, the arm 13 is turned directly above the turn table 11 so that the wafer is thrusted against a polishing cloth 17 on the rotating turn table 11. While the foregoing state is maintained, grinding liquid is fed to the polishing cloth 17 from a grinding liquid feeding apparatus (not shown).

The turn table 11 is composed of a circular disc-like lower turn table 18 and a circular disc-like upper turn table 19 each having a same diameter and concentrically combined with each other. The lower turn table 18 and the upper turn table 19 are circular disc-like members each made of a light metallic material such as aluminum or the like. The polishing cloth 17 is preliminarily adhesively attached to the upper surface of the upper turn table 19 using double-sided adhesive tape or the like. A rotary shaft 20 is concentrically jointed to the lower surface of the lower turn table 18 so that the rotary shaft 20 is supported rotatably relative to a housing 22 via a radial bearing 21.

The upper turn table 19 is detachably supported on the lower turn table 18. Four key blocks 24 are projected from the outer periphery of the lower turn table 18 in the equally space relationship, and cut grooves to which the key blocks 14 are fitted are formed on the outer periphery of the upper turn table 19. Thus, the upper turn table 19 and the lower turn table 18 are integrally rotated via the key blocks 24.

On the other hand, a stator 25 constituting a motor 23 for rotationally driving the turn table 11 is fixed to the inside of the housing 22, and a rotor 26 is fitted to the rotational shaft 20. A servomotor is used as the motor 23 so that the turn table 11 can be rotated at an arbitrary rotational speed by controlling the rotational speed.

A position determining sensor 27 is disposed at a predetermined position on the lower end of the rotational shaft 20, and the rotational position of the turn table 11 can be detected by detecting the position of the position determining sensor 27 by an access switch 28. In other hand, the turn table 11 can be positioned at the exchanging position where a chuck 44 of a conveying robot 43 to be described later can be engaged with the upper turn table 19 by stopping the rotation of the motor in response to a detecting signal of the access switch 28.

Other detecting means such as an encoder or the like can be used for this position determining and stopping means.

An axially extending passage 30 is formed through the center of the lower turn table 18 and the rotational shaft 20. The upper end opening portion of the passage 30 is opened at the lower surface of the upper turn table 19, while the lower end opening portion of the passage 30 is connected to a rotary joint 31 for feeding and discharging air in the passage 30 therethrough. The rotary joint 31 is connected to an air pressure circuit for feeding compressed air as well as a vacuum suction circuit via a shift controlling valve of which illustration is neglected herein. With this construction, compressed air having a predetermined pressure is fed to the passage 30 by actuating the pressure controlling valve, and by sucking vacuum, the pressure of the passage 30 is reduced to generate negative pressure.

On the other hand, a hot air blowing device 32 for drying the polishing cloth 17 is disposed in the proximity of the turn table 11, and moreover, a pure water feeding device 34 is disposed for cleaning the upper surface of the lower turn table 18 when the upper turn table 19 is exchanged with another one.

The hot air blowing device 32 includes a hot air pipe 33 which stands upright on the upper surface of the platform 15 in such a manner as to turn. It is desirable that the hot air pipe 33 includes a turning mechanism for recirocably turn the pipe 33 at 90° as well as a valve for controlling the blowing of hot air. The inlet end of the hot air pipe 33 is connected to a hot air source which is not shown, and a nozzle 35 having a nozzle port oriented in the downward direction is disposed at the fore end part of the hot air pipe 33 so as to allow hot air from the nozzle 35 to be blown toward the polishing cloth 17. The blowing position of the nozzle 35 is coincident with the peripheral edge portion of the polishing cloth 17.

The pure water feeding device 34 includes a pure water pipe 36 which is connected to a pure water supply source, and the pure water pipe 36 includes a turning mechanism for reciprocably turning by an angle of 90° and a valve for opening or closing the pure water feeding passage. In the case of the pure water feeding device 34, the pure water pipe 36 has a length which is sufficient to cover the radius width of the turn table 11, and a number of pure water blowing holes are axially drilled on the pure water pipe 36 so that pure water can uniformly be fed on the upper surface of the lower turn table 18.

In addition, a trough 46 is arranged to surround the periphery of the turn table 11. The trough 46 is vertically displaceably supported by cylinders 47, and it is raised and lowered in association with operations of the pure water feeding device 34 and the hot air blowing device 32.

On the other hand, an inlet/outlet port adapted to be opened or closed by a door 40 so as to infeed and outfeed the upper turn table 19 therethrough is arranged on the side surface of the cover 16, and the door 40 is connected to a raising/lowering motor 41 via a cable 42. The door 40 is normally located at the lowered position to close the inlet/outlet port therewith with the exception that the upper turn table 19 is exchanged with another one, and this opening portion serves to prevent foreign material from being scattered from the inside of the cover 16.

In FIG. 1, reference numeral 50 denotes a turn table holder disposed outside of the door 40. A multi-joint type conveying robot 43 is disposed between the turn table holder 50 and the grinding apparatus 10. By using the conveying robot 43, the used upper turn table 19 is taken out of the inside of the cover 16, and moreover, the new upper turn table 19A on the turn table holder 50 is brought inside of the cover 16. A chuck 44 adapted to be engaged with joint holes 45 formed on the side surface of the upper turn table 19 is disposed at a wrist portion at the foremost end of an arm of the conveying robot 43, and by fitting the chuck 44 into the joint hole 45, the upper turn table 19 can be held with a horizontal attitude.

As is apparent from FIG. 1, the turn table holder 50 is composed of a first turn table holder for holding an unused upper turn table 19A in the waiting state and a second turn table holder 54 for holding a used upper turn table 19B thereon. Among them, the second turn table holder 54 is covered with a cover 55 so as to prevent abrasive grains or the like from being scattered away therefrom. Incidentally, the cover 55 is opened or closed by a motor in operative association with operation of the conveying robot 43.

Next, an operation of exchanging a turn table with another one in the grinding apparatus as mentioned above will be described below.

On completion of a polishing operation for a semiconductor wafer, the arm 13 is turned about the center $O_1$ in the clockwise direction so that it is held in the waiting state at the retracted position.

When the motor 23 is driven, the lower turn table 18 and the upper turn table 19 are rotated together. While the turn table 11 is rotated as represented by phantom lines in FIG. 1, the pipe 33 of the hot air blowing device 32 is turned toward the turn table 11 side, and at the same time, hot air is blown toward the outer periphery of the upper turn table 19 from the nozzle 35 located at the foremost end of the pipe 33. In such manner, the upper turn table 19 can be dried by blowing hot air. In this case, it is not necessary that the polishing cloth 17 is completely dried by blowing hot air toward the whole surface of the polishing cloth 17 but it is sufficient that the lapping cloth 17 is dried to such an extent that water droplets do not drop from the outer periphery of the upper turn table 19. On the contrary, when the lapping cloth 17 is excessively dried, abrasive grains of the polishing agent and cut chips generated as a result of grinding the wafer are scattered away from the polishing turn table 11. For this reason, it is preferable that the polishing cloth 17 is dried to such an extent that water droplets do not drop from the outer periphery of the upper turn table 19.

While the lapping cloth 17 is dried by blowing hot air toward it, pistons of the cylinders 47 are extended to raise up the trough 46. At this time, since the trough 46 surrounds the upper turn table 19, scattering of the polishing liquid or the polishing agent can reliably be prevented. After the upper turn table 19 is dried by blowing hot air, the hot air pipe 33 of the hot air blowing device 32 is turned outward until it returns to the initial waiting position.

The door 40 of the cover 16 is raised up to open the inlet/outlet port, enabling the arm of the robot 23 to enter the inlet/outlet port. When the position determining sensor 27 reaches the access switch 28, the motor 23 is stopped in response to a output signal of the access switch 28, and at this time, the joint holes 45 of the upper turn table 19 of the turn table 11 are located at the rotational angular position opposite to the inlet/outlet port side.

Next, while the door 40 is kept opened, the wrist portion of the arm of the conveying robot 43 enters the inlet/outlet port so that the chuck 44 is engaged with the joint holes 45 of the upper turn table 19. In operative association with the operation of the conveying robot 43, compressed air having a predetermined pressure is ejected for several seconds toward the superimposing surface between the lower turn table 18 and the upper turn table 19 through the passage 30 extending through the rotational shaft 20 and the lower turn table 18. Since the upper turn table 19 is slightly floated up by the compressed air, the chuck 44 of the conveying robot 43 seizes the upper turn table 19 so that the upper turn table 19 can easily be disconnected from the lower turn table 18. When the conveying rob 43 disconnects the upper turn table 19 from the lower turn table 18, it slightly inclines the upper turn table 19 to disengage the key blocks 24 from the cutout grooves, and thereafter, the chuck 44 is retracted. In such manner, the upper turn table 19 is taken out of the cover 16 through the inlet/outlet port.

Next, the arm of the conveying robot 43 is turned by an angle of 180° so that the upper turn table 19 taken out in that way is held on the second turn table holder 64. When a upper turn table 19B is received on the second turn table holder 54, the cover 55 is raised up to be opened, an upper turn table 19B is placed on the second turn table holder 54, and thereafter, the cover 55 is lowered so as not to allow abrasive grains or the like to be scattered from the used upper turn table 19B.

Next, the arm of the conveying robot 43 is turned to the position located above the first turn table holder 52 where an used turn table 19B is placed so that the chuck 44 is engaged with the joint holes 45 of the upper turn table 19A so as to capture it.

On the other hand, before a new upper turn table 19A is conveyed in the grinding apparatus, the pure water feeding device 34 is turned until the foremost end of the pure water pipe 36 reaches to the center of the lower turn table 18, the lower turn table 18 tarts to be rotated, and pure water is blown to the lower turn table 18 from the pure water pipe 36 to sweep the surface of the lower turn table 18 with pure pipe. The water which sweeps the surface of the lower turn table 18 is recovered by the trough 46 which is held in the lowered state. After a sweeping operation is performed with pure water for several seconds, the pure pipe 36 is retrieved to the original waiting position.

While the arm of the conveying robot 43 holds the upper turn table 19, it is turned to the side of the grinding apparatus 10 and then enters through the inlet/outlet port of the cover 16 having the door 40 kept opened. After the conveying robot 43 places the upper turn table 19 on the lower turn table 18, the chuck 44 is disconnected from the joint holes 45, whereby the upper turn table 19 is exchanged with a new one having a new lapping cloth 17 adhesively attached thereto. Subsequently, the door 40 is lowered and the inlet/outlet port is kept closed.

Finally, to assure that the upper turn table 19 is brought in close contact with the lower turn table 18, vacuum suction is continuously effected though the passage 30 of the lower turn table 18 for several dozen seconds. While the upper turn table 19 is engaged with the key block 24 and comes in close contact with the lower turn table 18, a polishing operation can be performed while the polishing cloth 17 of a new exchanged upper turn table 19 is thrusted against a semiconductor wafer.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. A grinding apparatus for polishing a work by thrusting it against the surface of a rotating polishing cloth, comprising a lower turn table rotatably supported to rotate about a vertical shaft, an upper turn table concentrically and detachably arranged on said lower turn table, a polishing cloth being adhesively attached to the surface of said upper turn table, a first turn table holder for holding an unused upper turn table having a new polishing cloth preliminarily adhesively attached thereto, a second turn table holder for holding a used upper turn table thereon, said used upper turn table being disconnected from said lower turn table, a turn table exchanging device including chucking means capable of seizing said upper turn table and serving to convey a used upper turn table to said second turn table holder, and take an unused upper turn table from said first turn table holder to place it on said lower turn table, and position determining and stopping means for stopping said upper turn table at the rotational angular position where chucking means of said turn table exchanging device can be engaged with cutout grooves of said upper turn table.

2. The grinding apparatus as claimed in claim 1 further including a hot air blowing device for blowing hot air toward the outer peripheral part of a polishing cloth of said upper turn table.

3. The grinding apparatus as claimed in claim 1 or claim 2 further including a pure water cleaning device for feeding pure water to a turn table fitting surface of said lower turn table and a raising and lowering trough surrounding said lower turn table.

4. The grinding apparatus as claimed in claim 1 further including pressurizing means for feeding compressed air to a superimposing surface between said upper turn table and said lower turn table and vacuum sucking means for applying a negative pressure to said superimposing surface.

5. The grinding apparatus as claimed in claim 4, wherein a passage is formed through a central part of said lower turn table and a rotational shaft, and said passage is selectively changeably connected to a compressed air supply source or a vacuum sucking source.

6. The grinding apparatus as claimed in claim 1, wherein said turn table exchanging device is a conveying robot including chucking means adapted to be detachably engaged with an engagement portion of said upper turn table.

* * * * *